US006481501B2

(12) United States Patent
Chavez et al.

(10) Patent No.: US 6,481,501 B2
(45) Date of Patent: Nov. 19, 2002

(54) METHOD AND APPARATUS FOR DRILLING AND COMPLETING A WELL

(75) Inventors: Juan Carlos Chavez, Miranda (VE); Douglas Alexander Espin, Caracas (VE); Luis Carlos Genolet, Miranda (VE); Maria Alejandra Jimenez, Miranda (VE); Aaron Ranson, Miranda (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 09/739,616

(22) Filed: Dec. 19, 2000

(65) Prior Publication Data

US 2002/0074166 A1 Jun. 20, 2002

(51) Int. Cl.[7] ..... E21B 33/14
(52) U.S. Cl. ..... 166/285; 405/150.02
(58) Field of Search ..... 175/65; 166/285, 166/288, 289, 290; 405/150.2

(56) References Cited

U.S. PATENT DOCUMENTS

| | | | | |
|---|---|---|---|---|
| 2,776,111 A | | 1/1957 | Vance | |
| 3,100,544 A | | 8/1963 | Overly et al. | |
| 3,126,959 A | * | 3/1964 | Ortloff | 166/287 |
| 4,378,050 A | | 3/1983 | Tatevosian et al. | |
| 4,784,223 A | * | 11/1988 | Worrall et al. | 166/287 |
| 4,785,885 A | * | 11/1988 | Cherrington et al. | 166/285 |
| 5,894,897 A | | 4/1999 | Vail, III | |

FOREIGN PATENT DOCUMENTS

| | | |
|---|---|---|
| EP | 0403025 | 12/1990 |
| GB | 903826 | 8/1962 |

* cited by examiner

*Primary Examiner*—David Bagnell
*Assistant Examiner*—Daniel P Stephenson
(74) *Attorney, Agent, or Firm*—Bachman & LAPointe, P.C.

(57) ABSTRACT

A method for drilling and completing a well includes the steps of drilling through a subterranean formation with a drill bit so as to form a well bore having a side wall; applying a consolidating material to the side wall under pressure so that said consolidating material flows into the side wall and provides a coated side wall coated with the consolidating material; and passing a scraping member having a desired profile past the coated side wall so as to provide the coated side wall with the desired profile an apparatus is also provided.

8 Claims, 2 Drawing Sheets

METHOD AND APPARATUS FOR DRILLING AND COMPLETING A WELL

BACKGROUND OF THE INVENTION

The invention relates to a method and apparatus for drilling and completing a well and, more particularly, to a method and apparatus for simultaneous drilling and completion which allows for simplified drilling and easier data acquisition and transmission.

In the industry of producing hydrocarbons such as crude oil and gas from subterranean formations, wells are drilled from a surface location to the hydrocarbon bearing formation so as to allow production of the hydrocarbon.

Conventional drilling techniques involve the use of a drilling bit to drill-through various formations utilizing drilling mud which is circulated through a pipe to the drill bit and then back through the well to the surface. The drilling mud helps drill through the desired formation and serves as a vehicle for carrying cuttings from the formation back to the surface.

Drilling mud must be carefully weighted so that the weight of the column of fluid in the well is sufficient to balance formation pressure encountered during drilling. If this is not carefully maintained, high pressure formations can cause various undesirable disruptions in the drilling process. On the other hand, if the drilling fluid is too heavy, drilling fluid can invade and adversely affect potentially hydrocarbon producing formations.

Conventional wells are drilled in sections. After a particular length of a well is drilled, it is conventional to remove the drilling equipment and position a pipe or casing into the well. This casing is then cemented in place, and further drilling can then be carried out through the cemented cased section of the well. Although the casing resolves any potential problems with formation pressure in the drilled section, it should be readily apparent that this reduces the diameter of the originally-drilled hole, and therefore requires that the next section be drilled with a smaller drill bit. The end result is an ever-decreasing size of the well which of course is not desirable. Further, the need for cementing strings of casing into the well delays the drilling procedure and results in an added expense for the cost of pipe and equipment for positioning same.

Horizontal drilling is a development in the drilling art whereby wells are drilled at angles other than substantially vertical so as to reach other desired locations and/or position a well with maximum possible flow area in a producing formation. Unfortunately, horizontal drilling leads to still further complication in connection with positioning and cementing casing into the well.

Another disadvantage of conventional drilling techniques is that the casing, when positioned in the hole, is subject to corrosion, and may be adversely affected by erosion as well. Further, the casing can interfere with communication of electronic devices from the well into the formation, for example during logging and other procedures designed to obtain information about the well and formations which the well has been drilled through.

Based upon the foregoing, it is clear that the need remains for improved processes and devices for drilling and completing wells.

It is therefore the primary object of the present invention to provide such a method and apparatus.

It is a further object of the present invention to provide a method and apparatus which eliminates the need for conventional casing.

It is still another object of the present invention to provide a method and apparatus whereby the well does not have a gradually decreasing diameter.

It is yet another object of the present invention to provide a method and apparatus whereby the well is completed substantially simultaneously with drilling whereby balancing of formation pressure is not necessary.

Other objects and advantages of the present invention will appear hereinbelow.

SUMMARY OF THE INVENTION

In accordance with the present invention, the foregoing objects and advantages have been attained.

According to the invention, a method is provided for drilling and completing a well which method comprises the steps of drilling through a subterranean formation with a drill bit so as to form a well bore having a side wall; applying a consolidating material to said side wall under pressure so that said consolidating material flows into said side wall and provides a coated side wall coated with said consolidating material; and passing a scraping member having a desired profile past said coated side wall so as to provide said coated side wall with said desired profile.

In further accordance with the present invention, a drilling assembly for drilling and completing a well has been provided, which assembly comprises a drill bit member having a forward end for drilling through a subterranean formation; a drilling fluid conduit for conveying drilling fluid from surface to said forward end; a recycle conduit for receiving a mixture of said drilling fluid and cuttings from said formation at said drilling end and for conveying said mixture to surface; a consolidating material port positioned behind said forward end for applying consolidating material to walls of a well bore drilled by said forward end; a consolidating material conduit for feeding consolidating material from surface to said consolidating material port; and a consolidating material scraping member having a desired profile and positioned behind said consolidating material port for providing consolidating material on said walls with said desired profile.

BRIEF DESCRIPTION OF THE DRAWINGS

A detailed description of a preferred embodiment of the present invention follows, with reference to the attached drawings, wherein.

DETAILED DESCRIPTION

The invention relates to a drilling bit assembly and method which advantageously allow for substantially simultaneous drilling and completion of a well.

Figure 1:
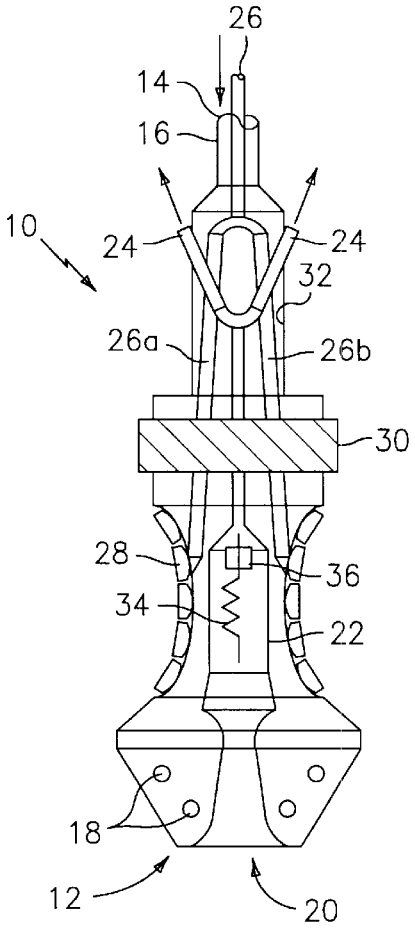
FIG. 1 is a side schematic view of a drilling bit assembly in accordance with the present invention.

FIG. 1 shows a side schematic view of a drilling assembly 10 in accordance with the present invention. As shown, drilling assembly 10 is preferably a substantially elongate member having a drilling bit 12 defined at one end thereof. Drilling assembly 10 also includes a drilling fluid inlet 14 for feeding drilling fluid to assembly 10. Drilling fluid is fed to drilling fluid inlet 14 through conventional means, typically through a pipe a portion 16 of which is shown in FIG. 1. Drilling fluid is conveyed from inlet 14 through assembly 10 to drilling bit 12, and is preferably discharged from drilling bit 12 through openings 18 so that drilling fluid is contacted with a geological formation through which bit 12 is being used to drill. Drilling assembly 10 also includes an inlet 20 for recycling drilling fluid back to the surface. This is particularly desirable since drilling. fluid entrains formation cuttings and other debris resulting from the drilling operation, and recycling the drilling fluid to the surface allows removal of such debris from the well. Inlet 20 leads to a recycled fluid conduit 22 which is advantageously vented to outside of drilling assembly 10 through outlets 24 as shown.

In accordance with the present invention, drilling assembly 10 advantageously is adapted for conveying consolidating material for use in establishing a completed wall along a well being drilled, and this consolidating material advantageously replaces conventional casing and the like and the need for conventionally placing and cementing such casing in the hole.

In accordance with the present invention, drilling assembly 10 has a conduit 26 for conveying consolidating material through assembly 10 to one or more ports 28 for feeding consolidating material to a well. As shown, consolidating material ports 28 are positioned behind drilling bit 12 such that consolidating material is disposed on walls of the well bore immediately after drilling. In accordance with the invention, consolidating material is advantageously fed through conduit 26 to ports 28 at a "over pressure", or a pressure which is designed and selected to minimally exceed formation pressure, such that consolidating material invades or permeates the surrounding formation to an extend sufficient to help anchor consolidating material in place.

In further accordance with the invention, drilling assembly 10 further advantageously includes a scraping member 30 positioned behind ports 28 and having a profile, preferably a round profile, which is selected to provide for a final desired profile of the well being drilled and completed. Scraping member 30 is positioned behind ports 28 such that consolidating material coated on walls of the well from ports 28 can then be scraped to provide an inner profile matching the profile of scraping member 30 as desired. Scraping member 30 may advantageously be any suitably-shaped member formed into the outer wall of assembly 10, or may advantageously be provided as a collar-type member that can be removed from and secured to drilling assembly 10 using conventional means and as desired.

FIG. 1 schematically shows the various conduits utilized in accordance with this embodiment of the present invention for independently feeding drilling fluid, recycling drilling fluid and cuttings, and feeding consolidating material. As shown, consolidating material is fed through conduit 26, which preferably branches into conduits 26*a* and 26*b*, each of which lead to ports 28 as desired. Further, recycled fluid conduit 22 passes from inlet 20 through drilling assembly 10 and extends, in this embodiment, between conduits 26*a* and 26*b* and eventually branches off into outlets 24 as shown. In accordance with the invention, drilling assembly 10 has an inner wall 32 defining an inner space through which each of these conduits are positioned. Inner wall 32 defines, in combination with conduits 22 and 26, an annular space which defines the inlet conduit for drilling fluid. As shown, drilling fluid is introduced between pipe 16 and conduit 26 and flows around conduits 22 and 26 toward drilling bit 12 to openings 18.

It should be noted that drilling bit 12 in accordance with the present invention may be any of numerous different types of drilling bits. For example, drilling bit 12 could be a conventional mechanical drilling bit. In addition, other methods of drilling such as laser or ultrasonic can be used, and any type of drill bit or drilling method would be acceptable in accordance with the invention.

In accordance with a preferred embodiment of the present invention, recycled fluid conduit 22 is advantageously provided with a grinding member 34 which is schematically illustrated in FIG. 1. Grinding member 34 advantageously serves to break up any large portions of cuttings, debris and the like which may be entrained in recycled drilling fluid so as to reduce the size of such debris to a size acceptable for flowing upwardly through drilling assembly 10. Grinding member 34 may be any suitable conventional devices will be well known to a person of ordinary skill in the art.

Recycling fluid conduit 22 may further advantageously be provided with a pump member 36, which is also schematically illustrated in FIG. 1, for creating vacuum at inlet 20 so as to pull drilling fluid and entrained debris into inlet 20 as desired.

Injection ports 28 may suitably be any type of acceptable jet nozzle and the like, which can advantageously be used to distribute consolidating material at the desired over pressure in accordance with the present invention.

Figure 2:
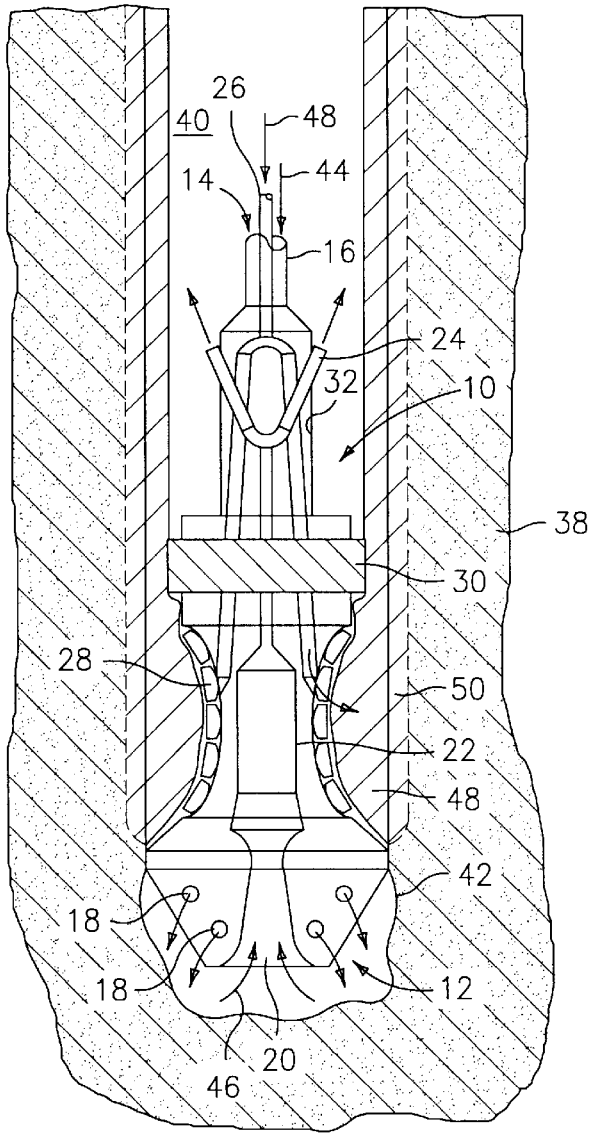
FIG. 2 is a side schematic view of a drilling and completing method in accordance with the present invention utilizing the drilling assembly of FIG. 1.

Turning to FIG. 2, a method for drilling utilizing assembly 10 in accordance with the present invention is illustrated. FIG. 2 shows assembly 10 being used to drill through a formation 38. Drilling bit 12, as shown, forms a well bore 40 having a wall 42. During drilling, drilling fluid 44 is fed to drilling assembly 10 and exits drilling bit 12 through openings 18 to facilitate drilling as desired. Drilling fluid mixes with cuttings and debris to form a mixture 46 which is pulled into inlet 20 and passed through conduit 22 for recycling to the surface. Mixture 46 is then preferably fed through grinding member 34 and pump 36 (both illustrated in FIG. 1), if desired and/or necessary and is eventually discharged from drilling assembly 10 through outlets 24 as shown for further recycling up through the completed well.

While drilling is being carried out, a consolidating material 48 is advantageously fed to conduit 26 and through conduit branches 26*a* and 26*b* to ports 28 wherein consolidating material 48 is disposed as a coating on wall 42. As shown, consolidating material 48 is applied at an over pressure such that a portion invades the surrounding formation, and this is illustrated in FIG. 2 by showing an invaded zone 50 into which consolidating material 48 has permeated the formation. Zone 50 advantageously enhances the secure positioning of consolidating material 48 within the well as desired. After application of consolidating material, scraping member 30 passes downwardly and serves to provide consolidated material 48 coated on wall 42 with a desired uniform profile.

Depending upon the consolidating material selected and various downhole conditions, it may be desirable to cure consolidating material applied to the well bore before scraping. Curing can be carried out utilizing any of a variety of known external energy techniques such as ultraviolet, heat, laser, electromagnetic and/or microwave curing and the like.

From a consideration of the foregoing, it should be readily appreciated that assembly 10 in accordance with the present invention advantageously allows for simultaneous drilling and completion of a well to any desired depth, without the need for casing and the interruption in drilling required for positioning of same.

It should further readily be appreciated that a well completed utilizing the assembly and method of the present invention advantageously has enhanced capability for data acquisition and data transmission, thereby allowing for enhanced knowledge of well characteristics.

Still further, the method and assembly of the present invention allow for substantially immediate completion of the well, as it is drilled, thereby greatly reducing the chance for problems incurred due to high pressure formations, and reducing and/or avoiding the need for carefully monitoring of fluid densities and the like.

The consolidating material used in accordance with the present invention may be any suitable material. The consolidating material is preferably a set table or curable material which is environmentally friendly, and which can be handled and injected in a fluid phase. Further, it is preferred that the consolidating material have a cementing agent which has a controllable and short curing time, preferably which can be controlled by pH and/or-water concentration, and which can be enhanced by means of external energy sources such as ultraviolet, heat, laser, electromagnetic wave and the like. The consolidating material may further suitably have elasticity properties which can be controlled or tailored by varying amounts of specific components, and is further preferably an electrically conductive structure, that is, a structure which does not interfere with communication of electronic devices within the well. Suitable electrical conducting structure would include cementing agent, lithic matrix and ceramic coating.

Consolidating material preferably has a collapse resistance of greater than about 1 Mpa, an internal yield resistance of greater than about 60 Mpa, low porosity and permeability (preferably as close to zero as possible), and a curing time of less than about 1 hour.

When permeable formations are being drilled through, the over pressure utilized is sufficient to partially invade the surrounding formation and anchor or secure the consolidating material in place. When drilling through low or non-permeable formations, it may be desirable to select the consolidating material so as to have adhesive qualities so as to anchor the material in place utilizing adhesive mechanisms instead.

As shown in FIG. 2, well bore 40 is drilled having a diameter conforming to the size of drilling bit 12, and the completed well has a single diameter the entire length of the well which is smaller than the diameter of the well bore by the thickness of completing material disposed on wall 42 in accordance with the present invention.

Upon completion of the well, the drill bit or tool must be removed through a hole which is of a narrow diameter than that through which the bit has drilled. Alternatively, the drill bit may be left in the hole.

In accordance with one embodiment of the invention, a drill bit structure is provided which has a collapsible outside diameter such that cutting elements, debris inlet, drilling seal, and the like of the tool can be longitudinally stretched or lengthened and diametrically withdrawn so as to allow drilling bit 12 to be removed.

Figure 3C:
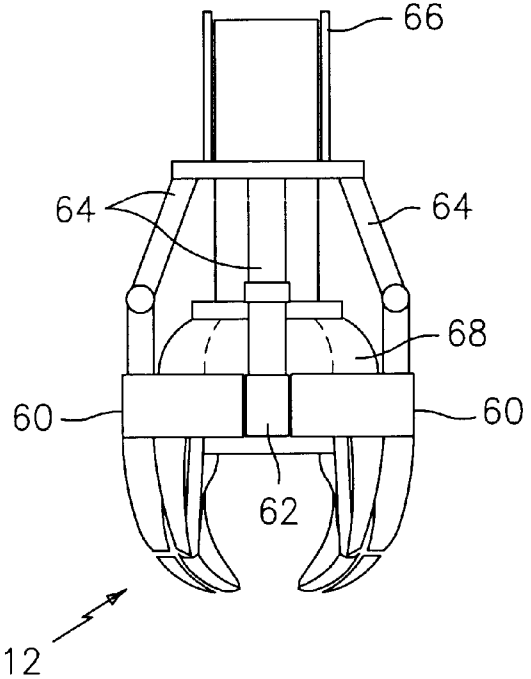
FIGS. 3*a–c* further illustrate the preferred embodiment of the invention.
Figure 3B:
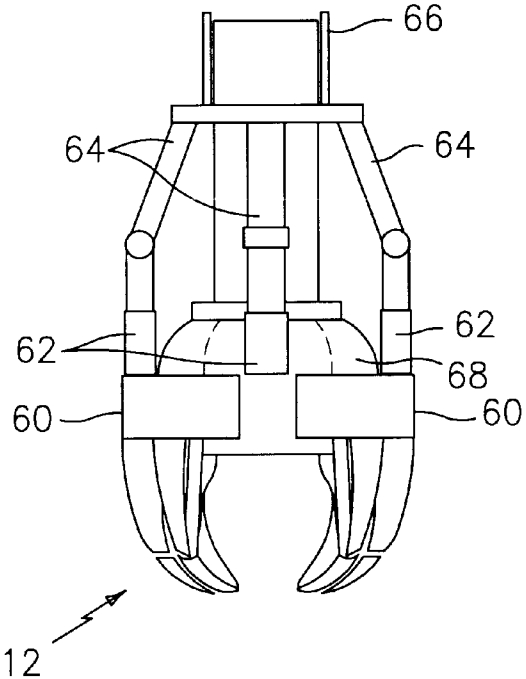
Figure 3A:
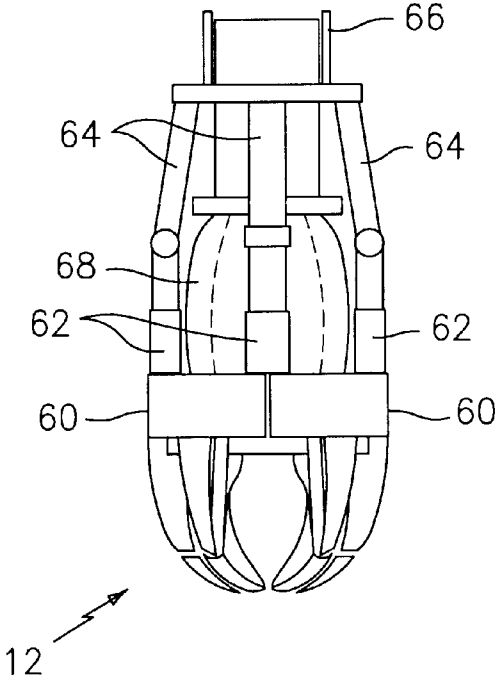

FIGS. 3*a, b* and *c* show one embodiment of such a drill bit 12.

In this embodiment, drill bit 12 has drilling seal members 60 which are provided in segments, and are adapted for radial expansion and contraction. Longitudinally positionable sealing wedges 62 are provided which can be positioned between drilling seals 60 (FIG. 3*c*), or removed from position between drilling seals 60 (FIGS. 3*a*, 3*b*), to allow the drilling tool to be expanded or withdrawn as desired. Coupling legs 64 can advantageously be cooperated with different members 66 of the drill string and used to control the diameter of. the drilling tool. In the embodiment shown in FIGS. 3*a–c*, drill string 66 is connected to a stretchable or resilient element 68 which is connected to drilling seal members 60. Upon upward movement of drill string 66, stretchable element 68 stretches longitudinally while coupling legs 64 pull sealing wedges 62 from between drilling seal members 60. Once the sealing wedges 62 are removed from between drilling seals 60, as shown in FIG. 3*b*, drilling seal member 60 can then collapse radially inwardly to the position as shown in FIG. 3*a*, at which point the drilling tool can be removed through the hole. Thus, drilling bit 12 in this embodiment is positionable between a relatively large diameter drilling configuration (FIG. 3*c*) and a relatively small diameter removal configuration (FIG. 3*a*) whereby bit 12 can be removed from a hole completed according to the invention.

Alternatively, a disconnect member can be positioned between the drill string and the drilling bit, which can be used to disconnect and leave the drill bit portion of the drilling assembly at the bottom of the hole, if preferable. In some instances, this may be desirable based upon a cost analysis for the drilling bit as compared to the cost of conventional tubing, cementing and the like. Any conventional disconnect structure would be used for this purpose.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for drilling and completing a well, comprising the steps of:

drilling through a subterranean formation with a drill bit so as to form a well bore having a side wall and feeding a drilling fluid to said drill bit during drilling;

applying a consolidating material to said side wall under pressure so that said consolidating material flows into said side wall and provides a coated side wall coated with said consolidating material;

passing a scraping member having a desired profile past said coated side wall so as to provide said coated side wall with said desired profile; and recycling said drilling fluid to surface substantially separate from said consolidating material which applying the consolidating material.

2. The method of claim 1, wherein said consolidating material is applied through a consolidating material port, and further comprising the step of providing a drilling assembly having said drill bit, said consolidating material port and said scraping member whereby said well is completed substantially simultaneously with drilling.

3. The method of claim 1, wherein said drilling fluid entrains cuttings from said formation during drilling, and further comprising the step of grinding said cuttings in said drilling fluid before recycling said drilling fluid to surface.

4. A drilling assembly for-drilling and completing a well, comprising:

a drill bit member having a forward end for drilling through a subterranean formation;

a first conduit means for conveying drilling fluid from surface to said forward end;

a second conduit means for receiving a mixture of said drilling fluid and cuttings from said formation at said drilling end and for conveying said mixture to surface;

a consolidating material port positioned behind said forward end for applying consolidating material to walls of a well bore drilled by said forward end;

a third conduit means for feeding consolidating material from surface to said consolidating material port; and a consolidating material scraping member having a desired profile and positioned behind said consolidating material port for providing consolidating material on said walls with said desired profile.

5. The apparatus of claim 4, wherein said drilling fluid conduit, said recycle conduit and said consolidating material conduit are defined through said assembly independently from each other.

6. The apparatus of claim 5, wherein said drilling assembly has an inner wall defining an inner space, said consolidating material conduit comprises at least one consolidating material tube communicated with said consolidating material port and extending away from said forward end through said space, wherein said recycle conduit comprises a recycle tube communicated with said forward end and extending away from said forward end through said space, and wherein said drilling fluid conduit comprises an annular space defined between said inner wall and at least one of said consolidating material tube and said recycle tube and extending rearwardly from said forward end.

7. The apparatus of claim 6, further comprising a grinding member positioned along said recycle conduit for grinding cuttings from said formation.

8. The apparatus of claim 4, wherein said forward end has a drilling diameter and wherein said scraping member has a round profile with a completing diameter, wherein said completing diameter is smaller than said drilling diameter so as to define a thickness for said completing material on said wall.

* * * * *